US007383599B2

(12) United States Patent
Gabbay

(10) Patent No.: US 7,383,599 B2
(45) **Date of Patent: *Jun. 10, 2008**

(54) ACTIVE HEAD/NECK POSITIONING DEVICE

(76) Inventor: Daniel S. Gabbay, 2706 Ridge Road Dr., Alexandria, VA (US) 22302

( * ) Notice: Subject to any disclaimer, the term of this patent is extended or adjusted under 35 U.S.C. 154(b) by 0 days.

This patent is subject to a terminal disclaimer.

(21) Appl. No.: 11/552,575

(22) Filed: Oct. 25, 2006

(65) Prior Publication Data

US 2007/0061974 A1 Mar. 22, 2007

Related U.S. Application Data

(63) Continuation of application No. 11/048,825, filed on Feb. 3, 2005, now Pat. No. 7,127,758.

(60) Provisional application No. 60/548,901, filed on Mar. 2, 2004.

(51) Int. Cl.
*A61G 13/12* (2006.01)

(52) U.S. Cl. ..... 5/633; 5/634; 5/644; 128/845

(58) Field of Classification Search ..... 5/633, 5/634, 640, 644, 645
See application file for complete search history.

(56) References Cited

U.S. PATENT DOCUMENTS

| | | | |
|---|---|---|---|
| 2,896,227 | A | 7/1959 | Reed |
| 4,259,757 | A | 4/1981 | Watson |
| 4,685,163 | A | 8/1987 | Quillen et al. |
| 4,829,614 | A | 5/1989 | Harper |
| 5,048,136 | A | 9/1991 | Popitz |
| 5,068,933 | A | 12/1991 | Sexton |
| 5,086,529 | A | 2/1992 | DeGroot |
| 5,184,365 | A | 2/1993 | Stafford |
| 5,528,783 | A | 6/1996 | Kunz et al. |
| 5,745,937 | A | 5/1998 | Weismuller et al. |
| 5,809,597 | A | 9/1998 | Shaw |
| 5,848,450 | A | 12/1998 | Oexman et al. |
| 5,966,762 | A | 10/1999 | Wu |
| 6,047,420 | A | 4/2000 | Priester, III et al. |
| 6,138,306 | A | 10/2000 | Muhanna |
| 6,151,735 | A | 11/2000 | Koby et al. |
| 6,397,415 | B1 | 6/2002 | Hsich |
| 6,401,279 | B1 | 6/2002 | Vaughn |
| 6,446,288 | B1 | 9/2002 | Pi |
| 6,751,818 | B2 | 6/2004 | Troop |
| 7,127,758 | B2 * | 10/2006 | Gabbay ..... 5/633 |
| 2002/0040501 | A1 | 4/2002 | Sharrock et al. |
| 2003/0098026 | A1 | 5/2003 | Saied |

* cited by examiner

*Primary Examiner*—Michael Trettel
(74) *Attorney, Agent, or Firm*—Gregory J. Gore

(57) ABSTRACT

A body support for positioning beneath a patient undergoing endotracheal intubation is dimensioned to extend beneath the patient's torso and head while in a substantially upward-facing prone position. An inflatable bladder is adapted to elevate the patient as the bladder is inflated and thereby expands. An expandable headrest is positioned for placement beneath the patient's head. The headrest further includes a head support air bladder which is operative to elevate the patient's head as the head support bladder is inflated and the headrest expands. A source of compressed air is in selective fluid communication by way of valve means with the torso support bladder whereby the patient's torso/head position may be altered to achieve optimal anatomical alignment of the patient's larynx for intubation. The valve means are preferably electromechanical valves which are actuated by thumbswitches located on a housing which is snap-fit to the top of the intubation handle.

7 Claims, 5 Drawing Sheets

ACTIVE HEAD/NECK POSITIONING DEVICE

RELATED APPLICATION

This patent application is a continuation of patent application Ser. No. 11/048,825 filed Feb. 3, 2005 for "Active Head/Neck Positioning Device for Endotracheal Intubation", now U.S. Pat. No. 7,127,758 which is related to provisional patent application Ser. No. 60/548,901 entitled "Active Head/Neck Positioning Device for Intubation" filed on Mar. 2, 2004, priority from which is hereby claimed.

FIELD OF THE INVENTION

The present invention generally relates to a head positioning device for facilitating endotracheal intubation. More specifically, it relates to an active laryngoscope-mounted, laryngoscopist-controlled adjustable head/neck positioning device for efficiently achieving the proper intubation position.

BACKGROUND OF THE INVENTION

Patient treatment in the medical arts often requires endotracheal intubation. Direct visualization of the larynx using a rigid laryngoscope constitutes the primary means of achieving endotracheal intubation and is called direct laryngoscopy. Integral to successful cannulation of the trachea is proper patient positioning. Frequently, this practice is overlooked by novice intubators. Even more important, proper patient positioning in the emergency setting is neglected or even dispensed with altogether due to the inherent time constraints related to emergent endotracheal intubation. Indeed, improper patient positioning is the most frequent cause of failed intubation in the difficult airway (defined as the inability to place an endotracheal tube on three attempts or within ten minutes). Manual attempts to obviate poor laryngeal view by manipulating patient position are nonstandard, unreliable and extremely time inefficient.

In the emergency setting, it is estimated that 99% of intubation attempts will ultimately be successful while in the operating room the failed intubation rate is only thought to be 5 to 35 per 10,000. Nevertheless, a difficult or failed intubation can result in death, brain injury, airway trauma, tracheal or esophageal perforation, pneumothorax and aspiration. Although direct laryngoscopy has been practiced for nearly a century, it was not until the 1990's that management of the "difficult airway" received serious attention. In recent years, there has been an attenuated need for invasive procedures like the cricothyrotomy with the advent of better training and the development of various airway adjuncts like the Combitube, Laryngeal Mask Airway (LMA), the Trachlite and Eschmann stylet (gum elastic bougie). Although a multitude of these airway management devices and "rescue" products are now available, methods other than direct laryngoscopy are seldom employed. In fact, proper patient positioning remains the primary means of achieving endotracheal intubation when laryngeal exposure is limited.

Successful endotracheal intubation using direct laryngoscopy is contingent upon alignment of the oral, pharyngeal and laryngeal axes in what is called the "sniffing position." In this position, the patient's head is slightly extended and the occiput is elevated approximately 7 cm. Often, positioning the patient in this manner is enough to obtain a reasonable POGO (percentage of glottic opening) score that allows identification of the usual laryngeal landmarks.

However, laryngeal exposure can be limited due to a multiplicity of factors. Distortion (trauma, infection, neoplasm, edema etc.), disproportion (tongue/pharynx) or body habitus (particularly obese patients), can all compromise landmark recognition and make the sniffing position suboptimal or even inadequate. The laryngoscopist can sometimes compensate for limited laryngeal exposure by lifting the patient's head off of the bed with the laryngoscope. The human head weighs 8 to 10 lbs. and, in obese patients, such lifting of the head and shoulders may be impossible. However, the medical literature has shown that laryngeal exposure can be improved with less required force by increasing head elevation and neck flexion. Without a mechanical device to enable this, massive amounts of support must be placed under the head and shoulders. To date, virtually no equipment has been developed to optimize patient head positioning when the difficult airway is encountered.

In order to achieve proper body positioning for endotracheal intubations, body support devices have been created. For example, U.S. Pat. No. 4,259,757 issued to Watson entitled "Support Cushion" discloses a cushion for medical use to support a patient's head and neck that can be utilized to achieve the sniffing position of the patient's head and torso to facilitate endotracheal intubations. However, the cushion is for support of the head only and cannot provide any support for the patient's shoulders or torso which is desired for a full support system to achieve the sniffing position of the patient. U.S. Pat. No. 5,048,136 discloses an infant support for airway management which aligns the oropharyngeal, laryngeal and tracheal axes of an infant. This support is in the form of a cushion with cut-outs which receive the head and torso of the infant. However, this mat is not adjustable in any way. Adjustable head and torso supports are known for example as shown in U.S. Pat. No. 5,528,783 issued to Kunz et al. This patent discloses an inflatable head and torso support which is adjustable by the user whereby an air bladder can be fully inflated, partially inflated, or fully deflated as desired by the user to incline the head or the head and torso. Inflation is controlled by valves that are in turn actuated by switches located on the edge of a sheet of material positioned under the torso of the user and attached to the support. The support is wedge-shaped and contains only one bladder. Therefore, it is incapable of individually elevating the head and torso portions of the user's body independently and therefore would not be appropriate as an ideal tracheal intubation body positioning support.

There is therefore a need in the art for a patient positioning system that allows the patient's body position to be changed and controlled as needed in order to achieve the best possible position for endotracheal intubation.

SUMMARY OF THE INVENTION

In order to overcome the problems with the prior practice of endotracheal intubation body positioning, the present invention has been devised. The device's versatility ensures that a patient can be routinely placed upon this intubation mat as the necessary 7 cm of head elevation to achieve the standard "sniffing" position is intrinsically provided. Should a difficult airway be encountered and the usual laryngeal landmarks cannot be visualized, the device is in place and ready to be employed. Toward this end, the invention utilizes a pneumatically controlled intubation mat with laryngoscope-mounted controls. It is an "active," hands-free, body positioning device that provides subtle and controlled changes to the patient's head/thorax position. The intubator can separately control inflation of the occiput bladder to achieve slight neck flexion as well as controlling a much larger, inflatable wedge that would elevate the patient's head and torso in conjunction with neck flexion to enhance laryngeal exposure. Since this device is operated with controls that attach easily to a standard laryngoscope, no additional airway equipment must be purchased to utilize this product and the intubator need not avert his/her eyes from the larynx while glottic exposure is optimized. This significantly decreases the likelihood of inadvertent esophageal intubation. Another advantage of this invention is that it can sensitively and rapidly respond to intubator-initiated control inputs allowing "fine-tuning" of the laryngeal view in real-time, i.e. the person performing the intubation can watch the laryngeal landmarks come into view with pneumatically manipulated head elevation/neck flexion. Thus, the intubation mat according to the invention reduces the need for an invasive procedure when a potentially difficult airway is encountered and enhances routine intubations by facilitating alignment of the three major airway axes.

More specifically, the applicant has devised a body supporting mat for positioning a patient undergoing endotracheal intubation comprising a base position beneath a mat board which is dimensioned to extend beneath the patient's torso and head for placement beneath the patient while in a substantially upward-facing prone position. An inflatable bladder is positioned between the base and the mat board which is adapted to elevate the mat board with respect to the base as the bladder is inflated and thereby expands. An expandable headrest is affixed to a top surface of the mat board and is positioned for placement beneath the patient's head. The headrest further includes a head support air bladder which is operative to elevate the patient's head as the head support bladder is inflated and the headrest thereby expands. A source of compressed air is in fluid communication with the torso support bladder and the head support bladder by way of an air distribution manifold. The valve means on the air distribution manifold selectively conduct pressurized air from the source to the torso support bladder and the head support bladder whereby the patient's torso/head position may be altered to achieve optimal anatomical alignment of the patient's larynx for intubation. The valve means are preferably electromechanical valves which are actuated by thumbswitches located on a housing which is snap-fit to the top of an intubation handle. There are four valves, each valve being connected to one of the torso support bladder supply and exhaust conduits and head support bladder supply and exhaust conduits. Any source of compressed air may be used with the inflatable mat, however a mechanical air compressor is preferred.

Thus, the purpose of the invention is to safely and reliably optimize patient positioning during both routine and difficult endotracheal intubations. It is therefore the primary object of the present invention to mechanically facilitate successful endotracheal intubation by automatically adjusting patient positioning when laryngeal exposure is poor. It is a further object to provide a powered adjustable intubation mat that may be controlled from the laryngoscope handle. It is yet another object of the invention to provide an adjustable intubation mat which is easy to use, reliable, and convenient. Other objects and advantages will become apparent to those of skill in the art from the following drawings and description of the preferred embodiment.

DESCRIPTION OF THE PREFERRED EMBODIMENT

Figure 1:
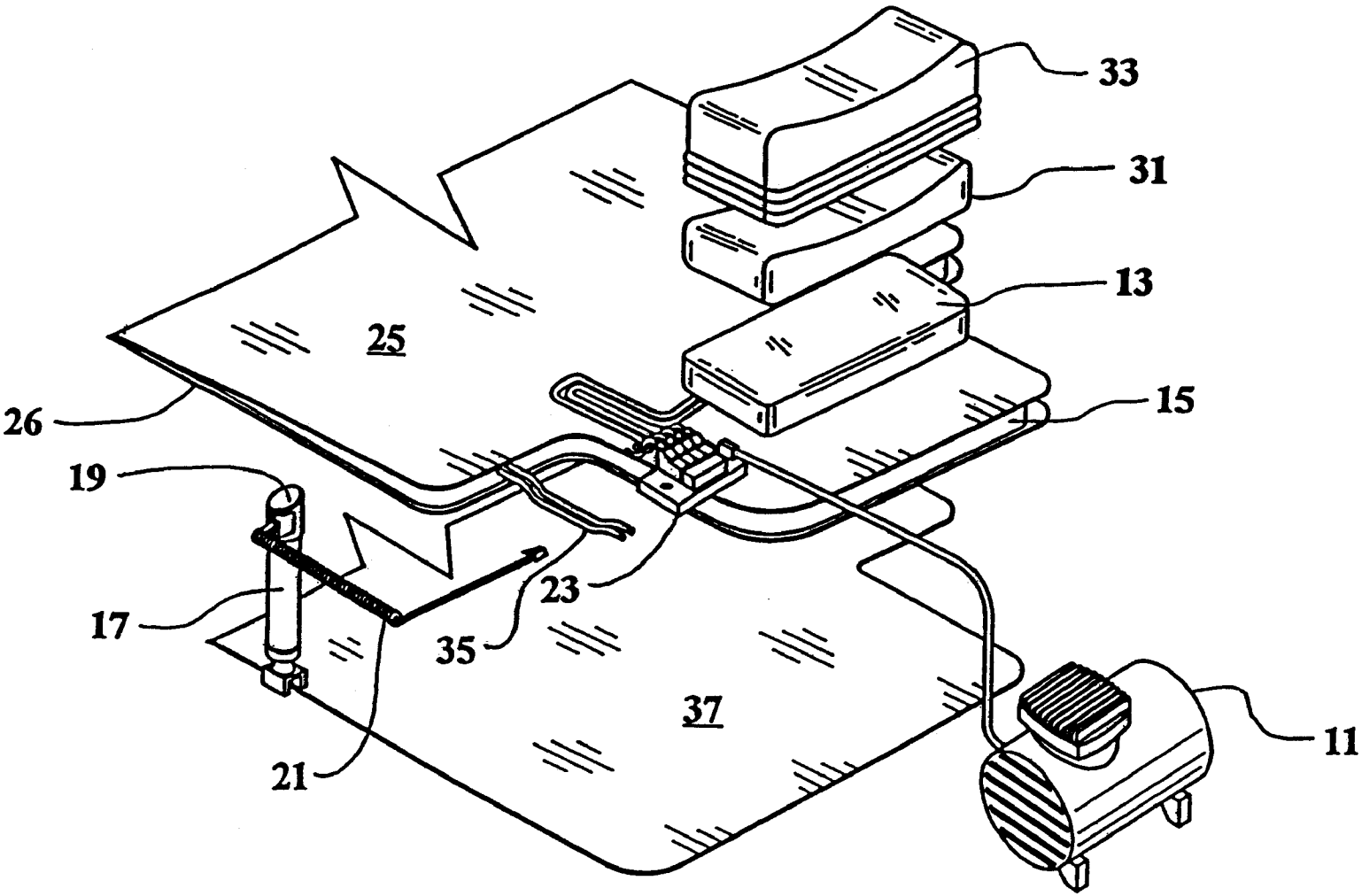
FIG. 1 is a top right rear isometric assembly view of the invention.

Referring now to FIG. 1 the present intubation mat device shows the basic components of the invention including a compressor 11 which provides a source of compressed air, a distribution manifold 23 for delivering the compressed air to either the head support bladder 13 or the torso support bladder 15, the intubation handle 17 fitted with the thumbswitch 19 and associated electrical wiring 21 which is connectable to the air distribution manifold 23, and top and bottom mat boards 25 and 26 which form the main portion of the body-supporting mat of the invention. The top board 25 includes a contoured head support 31 and an accordion-like expandable cover 33. The bottom board includes an inflatable bladder 15 connected to the air distribution manifold 23. The mat boards and distribution manifold are supported by base member 37.

Figure 2:
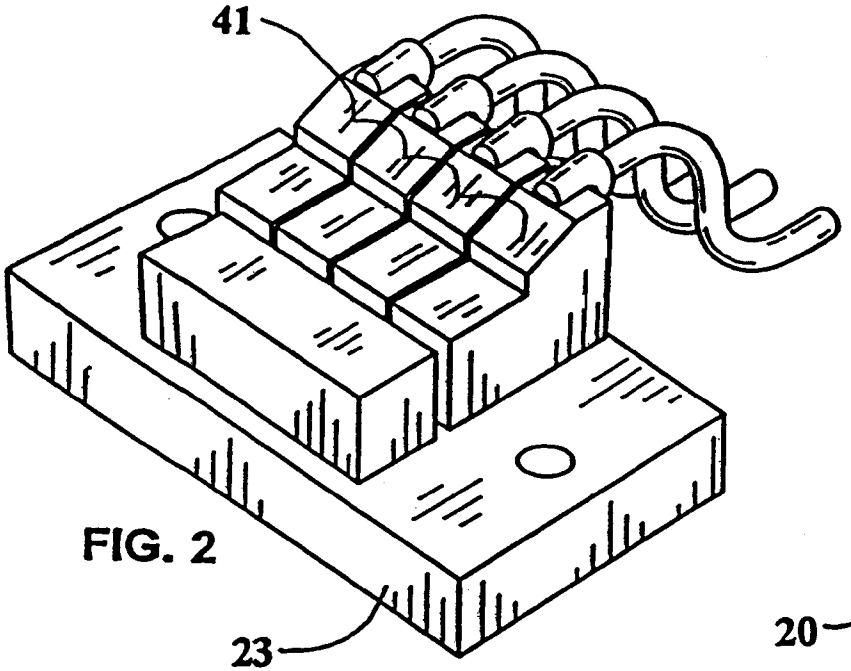
FIG. 2 is a top right rear isometric view of the pneumatic distribution valve of the invention.

Referring now to FIG. 2, the air distribution manifold 23 is shown in isolation. This manifold receives compressed air and distributes it selectively by electrically controlled valves 41 to either the headrest or the torso support. The manifold also receives exhaust conduits from both the headrest and the torso support to control the deflation of their respective bladders. Therefore four valves are utilized, each controlling an inflow and exhaust conduit for each bladder. The electrical circuitry and valves required by this manifold are well known in the arts and by themselves form no part of the present invention.

Figure 3:
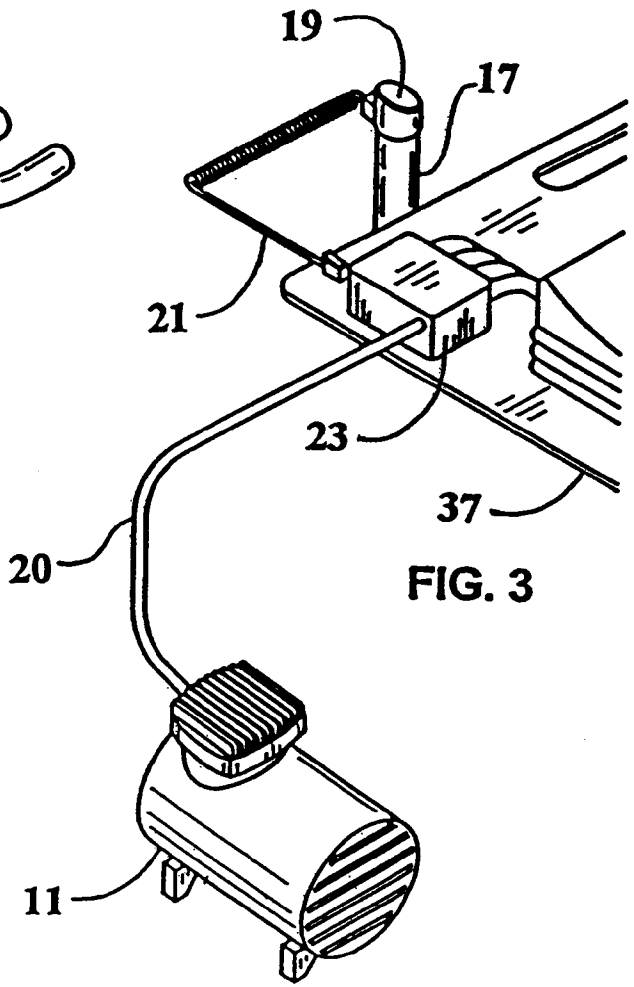
FIG. 3 is a top right rear partial view of the invention.
Figure 4B:
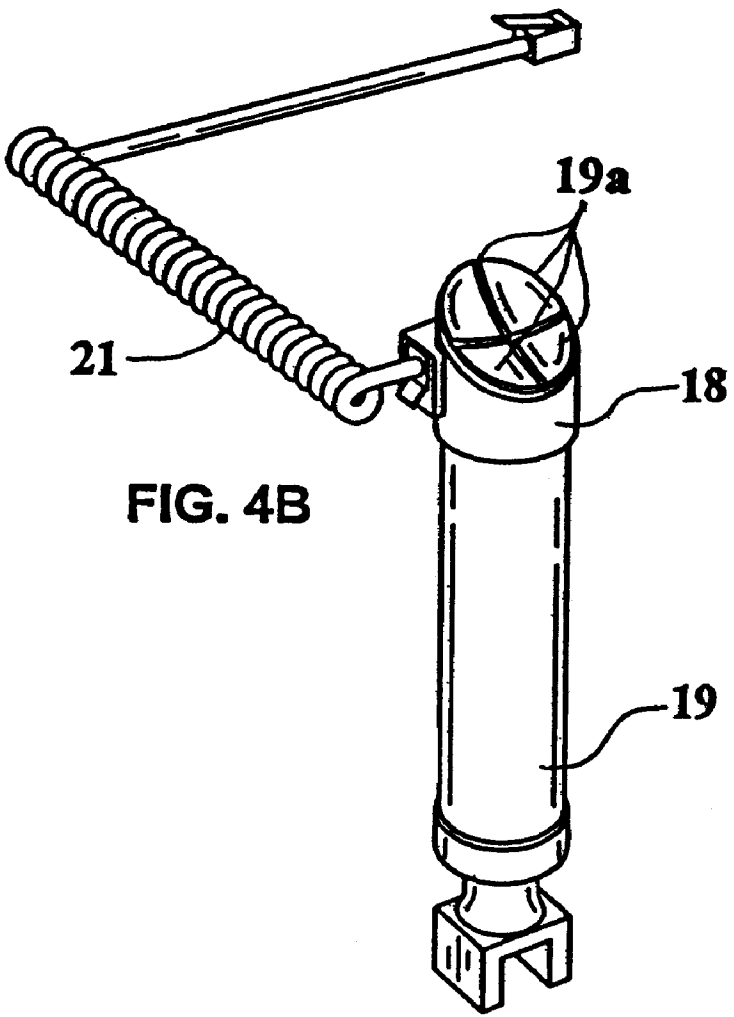
FIGS. 4A and 4B are top left front isometric views of the intubation handle and thumbswitch shown detached and assembled.
Figure 4A:
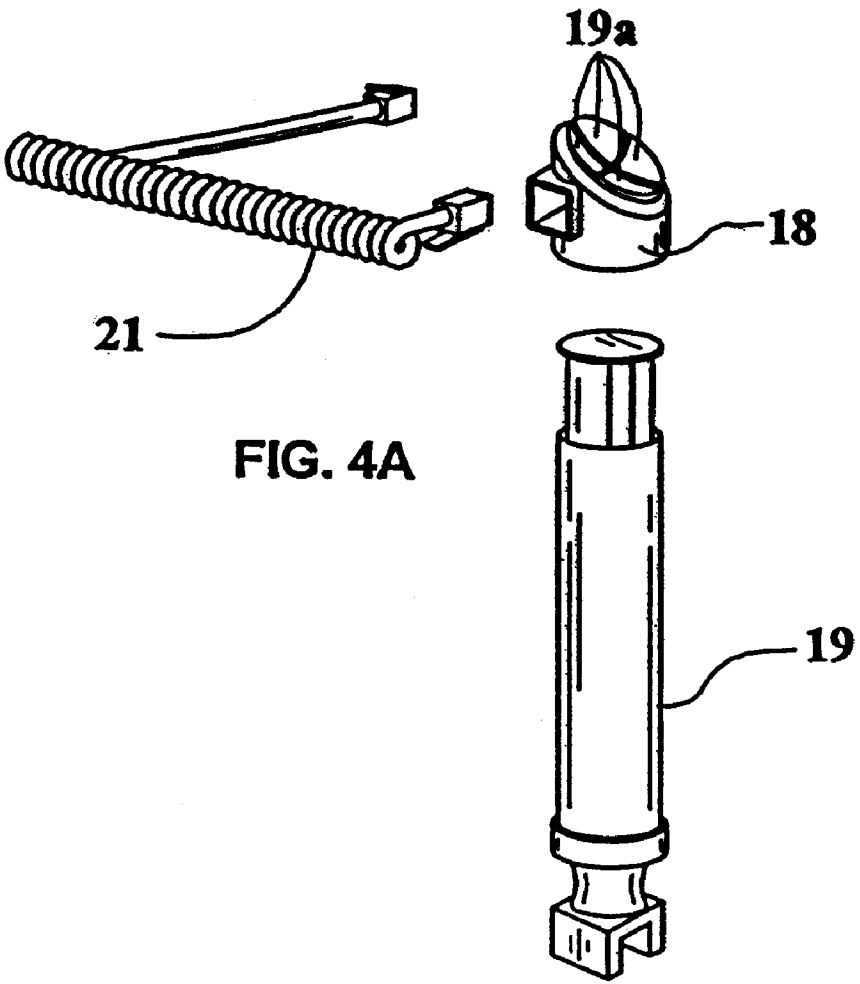

Referring now to FIG. 3, the compressor is shown connected to the air distribution manifold 23 which includes a releaseable coiled electrical cord 21 used to control the manifold by a thumbswitch 19 at the top of the laryngoscope handle 17 which is shown in greater detail in FIGS. 4A and 4B. The manifold is mounted to base 37. The line 20 from the compressor to the distribution manifold also carries the electrical power supply for powering the electrically operated valves in the air distribution manifold.

Referring now to FIGS. 4A and 4B, the manifold valves are controlled by the individual thumbswitches 19*a* which are contained by switch housing 18 applied to the top of the intubation handle. An extendable electrical cord 21 which is plug-in attached to both the handle switch means and the distribution manifold is also shown. FIG. 4B shows these detachable components depicted in FIG. 4A now in their assembled state. The switches are mounted in a housing which may be snap-fit to the top of the intubation handle. Utilizing these switch means, it is possible to manually maneuver the laryngoscope while simultaneously depressing one of the four switches, thus simultaneously changing the torso and head position of the patient to obtain the proper body positioning as the laryngoscope is being inserted into the patient's airway. This may be accomplished by the attending physician without diverting his/her gaze from the patient's airway.

Figure 5A:
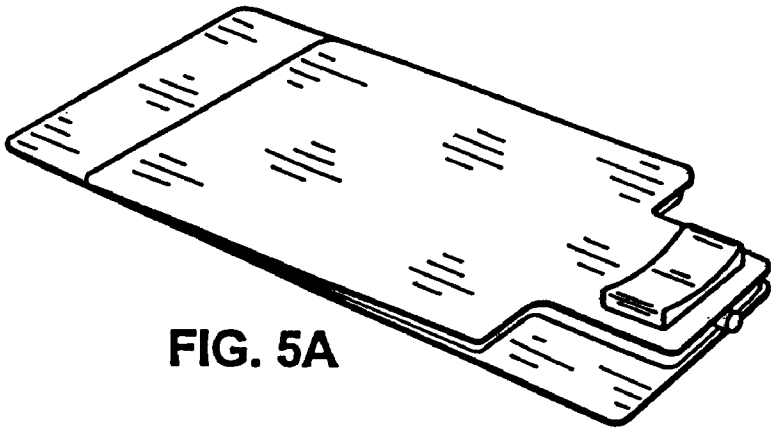
FIG. 5A is a view showing the mat of the present invention in isolation in its deactivated state.
Figure 5B:
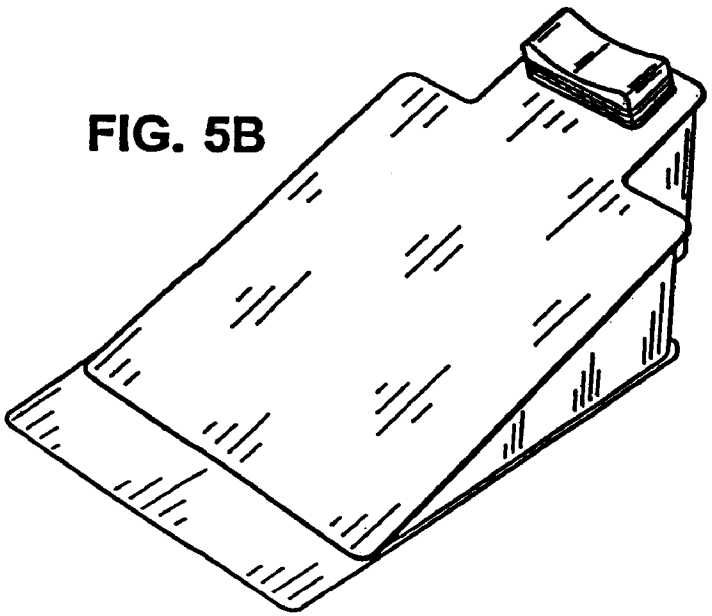
FIG. 5B is a top right front isometric view of the intubation mat shown in isolation with the wedge portion and the head support partially inflated.
Figure 5C:
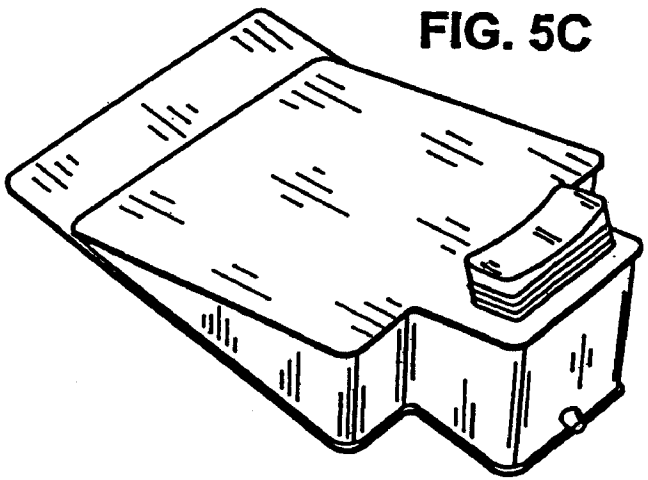
FIG. 5C is a view showing the present invention with the torso supporting wedge portion and the head support fully extended.

FIGS. 5A-5C show the intubation mat in isolation in various stages of its inflation from the fully deflated position shown in FIG. 5A to a fully inflated position shown in FIG. 5C. Since the headrest and the torso support can be individually controlled, it will be readily understood that any combination of headrest position and torso support position can be achieved. Since the movement of these two support devices is controlled by air pressure, very small changes in either the head or the torso position can be achieved. Some of these positions are shown in FIGS. 6A-6C.

Figure 6A:
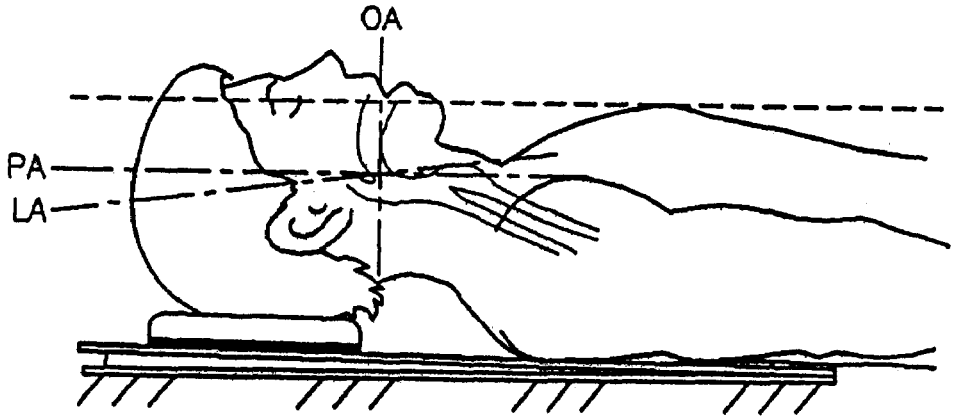
FIGS. 6A-6C are left side elevation views of the present invention supporting a patient in three different positions.

Referring now to FIG. 6A, the patient is shown reclining on an inflatable mat of the invention which is positioned behind the patient's shoulders and upper torso with the head support underneath the back of the head. In this figure, both the main wedge-like torso support bladder and the headrest support are fully deflated. In the fully deflated state, 7 cm. of head elevation is provided to help align the various axes drawn in this figure. Line OA represents the oral axis, Line PA represents the pharyngeal axis, and Line LA depicts the laryngeal axis. This helps to achieve the aforementioned "sniffing position" necessary for most routine endotracheal intubations.

Figure 6B:
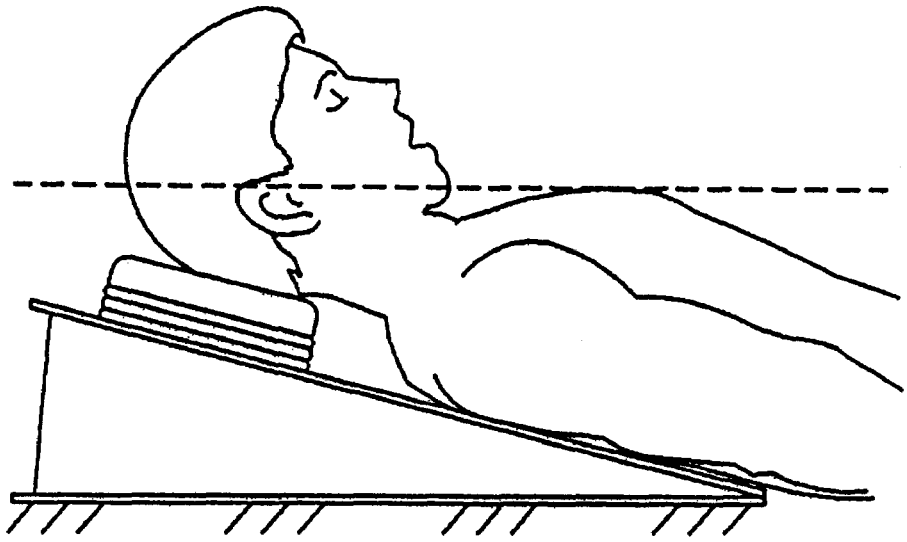

Referring now to FIG. 6B, when both the torso support bladders and head support bladders are expanded, the patient would be supported in this position. The horizontal dotted line is a reference point that is a rough approximation of the proper patient intubation position when the difficult airway is encountered. The patient's ear should be approximately in alignment with the patient's chest. It can be seen that the patient's ear is at the proper level with respect to his chest, the neck is flexed and the head is tilted forward. Therefore, as in the case of FIG. 6A, the patient position shown in FIG. 6B may in some instances be adequate for endotracheal intubation.

Figure 6C:
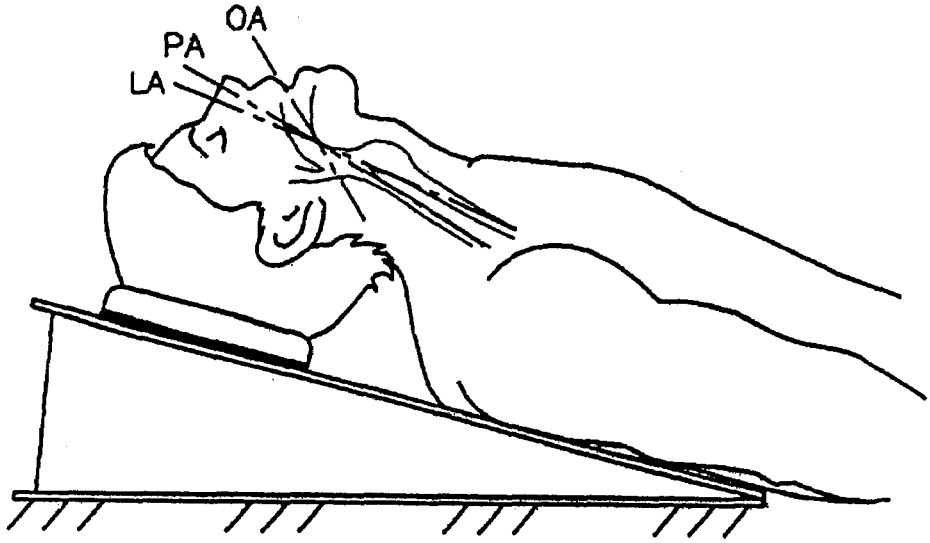

Referring now to FIG. 6C, relative to FIG. 6B the head support has been lowered by deflating the air bladder contained therein. This causes the patient's head to tilt backward and places the three airway axes into closer alignment. These movements result in the desired sniffing position which can be obtained in concert with varying degrees of head elevation when difficult endotracheal intubation is encountered. Thus, by the three FIGS. 6A-6C, it has been demonstrated that the present support device may be utilized to achieve different patient body positions by independently controlling the amount of torso and head support. This is achieved by inflating or deflating the two air bladders as described with regard to FIGS. 5A-5C.

It will therefore be understood that the present invention achieves all the desired objects and advantages of an active inflatable intubation patient support mat which can be used to position the patient's head and torso properly to facilitate intubation. More importantly, it may be finely controlled by the use of a hand control on the laryngeal scope so that changes in the body position can be made while the laryngoscopy procedure is carried out without the clinician's attention or visualization being diverted away from the patient. It will be understood that there will be other modifications that will be apparent to those of ordinary skill in the art, however these obvious variations will not represent a departure from the nature and spirit of the invention which should be determined only by the applicant's claims and their legal equivalents.

What is claimed is:

1. A body support for positioning a patient undergoing endotracheal intubation, comprising:

an inflatable torso support bladder for placement beneath the patient while in a substantially upward-facing prone position, said torso support bladder being dimensioned to extend beneath the patient's upper torso and head, and said bladder adapted to elevate the patient's upper torso and head as the bladder is inflated and thereby expands;

an inflatable headrest positioned for placement beneath the patient's head, said headrest further including a head support air bladder which is operative to elevate the patient's head as the head support bladder is inflated and thereby expands;

a source of compressed air in fluid communication with said torso support bladder and said head support bladder by way of an air distribution manifold; and valve means on said air distribution manifold for selectively conducting pressurized air from said source to said torso support bladder and said head support bladder whereby the patient's torso/head position may be altered to achieve optimal anatomical alignment of the patient's larynx for intubation.

2. The body support of claim 1 wherein said valve means are electromechanical valves.

3. The body support of claim 2 wherein said electromechanical valves are actuated by thumbswitches located on an intubation handle.

4. The body support of claim 3 wherein the thumbswitches are mounted in a housing affixed to a top of the intubation handle.

5. The body support of claim 4 wherein the means of attachment of said thumbswitch housing to said intubation handle is by snap-fit.

6. The body support of claim 1 wherein the source of compressed air is a mechanical air compressor.

7. The body support of claim 1 wherein said valve means comprise four valves, each valve connected to one of said torso support bladder supply and exhaust conduits and head support bladder supply and exhaust conduits.

* * * * *